US006182983B1

(12) United States Patent
Kim

(10) Patent No.: US 6,182,983 B1
(45) Date of Patent: Feb. 6, 2001

(54) GOLF BAG EQUIPPED WITH DETACHABLE CARRIER

(75) Inventor: Jung Han Kim, Seoul (KR)

(73) Assignee: King Tiger Corp., Seoul (KR)

( * ) Notice: Under 35 U.S.C. 154(b), the term of this patent shall be extended for 0 days.

(21) Appl. No.: 09/365,104

(22) Filed: Jul. 30, 1999

Related U.S. Application Data

(63) Continuation-in-part of application No. 09/167,881, filed on Oct. 7, 1998, now Pat. No. 6,068,270.

(30) Foreign Application Priority Data

Apr. 29, 1999 (KR) ..... 99-15455

(51) Int. Cl.[7] ..... B62D 21/14

(52) U.S. Cl. ..... 280/47.26; 206/315.3; 206/315.7; 280/43.1; 280/DIG. 6

(58) Field of Search ..... 280/DIG. 6, 47.17, 280/47.18, 47.24, 47.26, 47.315, 641, 38, 645, 42, 646, 652, 655, 655.1, 47.371, 47.3, 43.1, 651; 206/315.3, 315.4, 315.7

(56) References Cited

U.S. PATENT DOCUMENTS

| | | | | |
|---|---|---|---|---|
| 2,538,374 | * | 1/1951 | May | 280/41 |
| 2,760,782 | * | 8/1956 | Hartzell | 280/36 |
| 2,770,466 | * | 11/1956 | Pearson et al. | 280/41 |
| 3,079,166 | * | 2/1963 | Abgarian | 280/40 |
| 4,648,612 | * | 3/1987 | Park | 280/47.26 |
| 4,735,425 | * | 4/1988 | Hoff | 280/47.18 |
| 4,911,465 | * | 3/1990 | Hauer | 280/646 |
| 5,516,142 | * | 5/1996 | Hartan | 280/642 |
| 5,915,723 | * | 6/1999 | Austin | 280/47.371 |
| 5,921,574 | * | 7/1999 | Driessen et al. | 280/655.1 |

* cited by examiner

*Primary Examiner*—Brian L. Johnson
*Assistant Examiner*—Gerald B Klebe
(74) *Attorney, Agent, or Firm*—Snell & Wilmer, LLP

(57) ABSTRACT

A golf bag equipped with a detachable carrier 1. The golf bag equipped with a carrier comprising: an inner plate 100 attached to the inner peripheral edge of said golf bag; an outer plate 200 fastened to said inner plate 100 at the position of the outer peripheral edge of said golf bag; a leg unit 300 rotatably coupled with the front face of said outer plate 200; a first bearing unit 210 coupled with the front face of said outer plate for controlling the angle of said leg unit 300; a cover 250 coupled with the front face of said outer plate 200; a wheel unit 400 coupled with the lower part of said leg unit 300 for moving said golf bag; and a handle unit 500 coupled with the upper side of the outer peripheral edge of said golf bag. The present invention provides a golf bag equipped with a carrier capable of simply and conveniently carrying the golf bag by coupling the carrier to the body of the golf bag without a separate cart. In non-use, it is capable of keeping the golf bag and the carrier in separated state or packing them in a box. Also, it is capable of easily adjusting the angle of the carrier while carrying the golf bag and standing it on the ground. Furthermore since the golf bag has a simple construction and a small number of parts, and the wheel unit is able to be separated, it is capable of easily replacing the damaged parts when problems are generated.

23 Claims, 14 Drawing Sheets

GOLF BAG EQUIPPED WITH DETACHABLE CARRIER

This application is a continuation-in-part of U.S. application Ser. No. 09/167,881 filed Oct. 7, 1998 now U.S. Pat. No. 6,068,270.

BACKGROUND OF THE INVENTION

1. Field of the Invention

The present invention relates to the field of golf implements and accessories. More specifically, the present invention relates to a golf bag equipped with a detachable carrier that is particularly designed to provide wide utility to a golfer and enhance the enjoyment and convenience of the game.

2. Description of the Prior Art

In case of a conventional golf bag, it is difficult for the golfer to carry it in a wide golf course that golf is played on because the golf bag is designed to be carried on his/her shoulder or in his/her hand. Accordingly the greater part of golfers make use of separate carrying devices such as golf carts or golf carriers or go with caddies to carry the golf bag for them who are playing golf. Nevertheless carrying the golf bag is still troublesome due to the weight and volume of the carrying device itself.

In this reason, the golf bag equipped with a carrier has been developed. However since several such brands and styles of a golf bag carrier known and widely used on golf courses have many parts and complicated structures to adjust the angle of the carrier, it is difficult to manipulate the carrier and manufacturing costs become rising. Also, since the conventional golf bag carrier is mounted to the mediate between left side and right side of the golf bag, the golf bag is hung down due to the weight thereof, thus the connection part between the carrier and the golf bag is capable of easily being damaged. When the connection part is damaged, it is difficult to exchange only the damaged part due to the complicated construction, thus the entire of the golf bag carrier must be repaired.

SUMMARY OF THE INVENTION

Accordingly, the present invention has been made keeping in mind the above problems occurring in the prior art, and an object of the present invention is to provide a golf bag equipped with a carrier which is capable of easily carrying the bag in any ground state and securely making it stand on the ground by simply and easily operating the angle of the carrier with respect to the golf bag.

Another object of the present invention is to provide a golf bag equipped with a carrier that is capable of easily being detached from the bag in non-use or in packing.

A further object of the present invention is to provide a golf bag equipped with a carrier that is capable of preventing it from being damaged due to the hang down phenomenon of the golf bag.

A further another object of the present invention is to provide a golf bag equipped with a carrier which is capable of easily carrying it in a comfortable posture by freely manipulating the angle of the handle when a golfer or a caddy carries it on the field.

A further another object of the present invention is to provide a golf bag equipped with a carrier which has a simple construction and a small number of parts, thereby remarkably reducing possibilities of troubles and weights of it.

A further another object of the present invention is to provide a golf bag equipped with a carrier which is capable of easily detaching/attaching wheels of the carrier according to an user's intention, thereby resolving the trouble of assembling work due to the size or weight of the carrier.

In order to accomplish the above objects, a golf bag equipped with a carrier according to the present invention comprises: a pair of supporting plates fixed in a body of the golf bag; a pair of main plates detachably mounted to the supporting plates; a pair of leg units rotatably/fixedly mounted to the main plates; a pair of wheel units engaged with the lower end of the leg units; and a handle unit engaged with the upper side of the body of the golf bag.

BRIEF DESCRIPTION OF THE DRAWING

These and other objects and advantages of the present invention will be more clearly understood from the following detailed description taken in conjunction with the accompanying drawings, in which.

DETAILED DESCRIPTION OF THE PREFERRED EMBODIMENT

The golf bag equipped with a detachable carrier according to the present invention is below described with reference to the accompanying drawings. The preferred embodiments in this specification describe only typical examples and are not intended to restrict the scope of the present invention.

Figure 1:
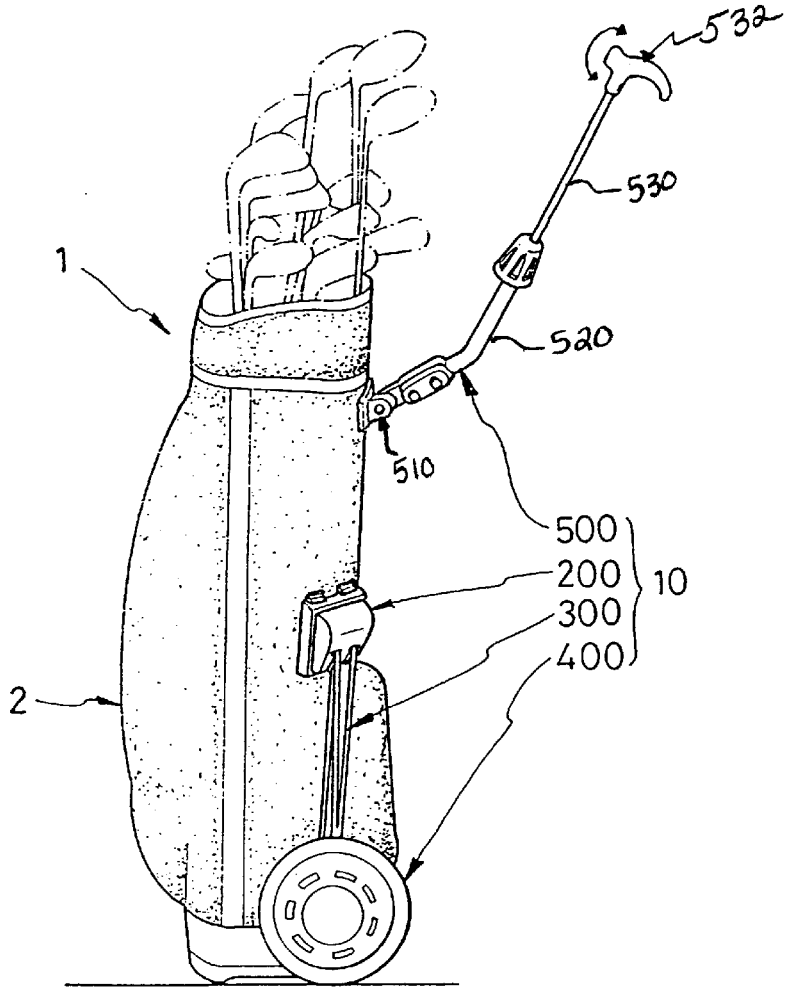
FIG. 1 is a perspective view showing a folded state of the golf bag carrier in accordance with an embodiment of the present invention.
Figure 2:
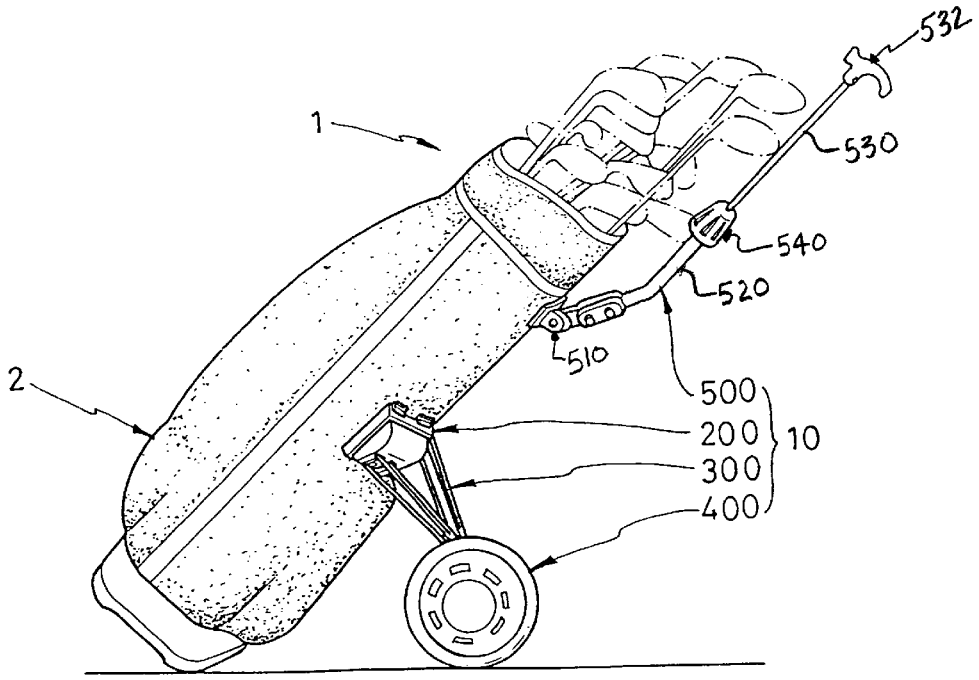
FIG. 2 is a perspective view showing a unfolded state of the golf bag equipped with a detachable carrier in accordance with the embodiment of the present invention.
Figure 3:
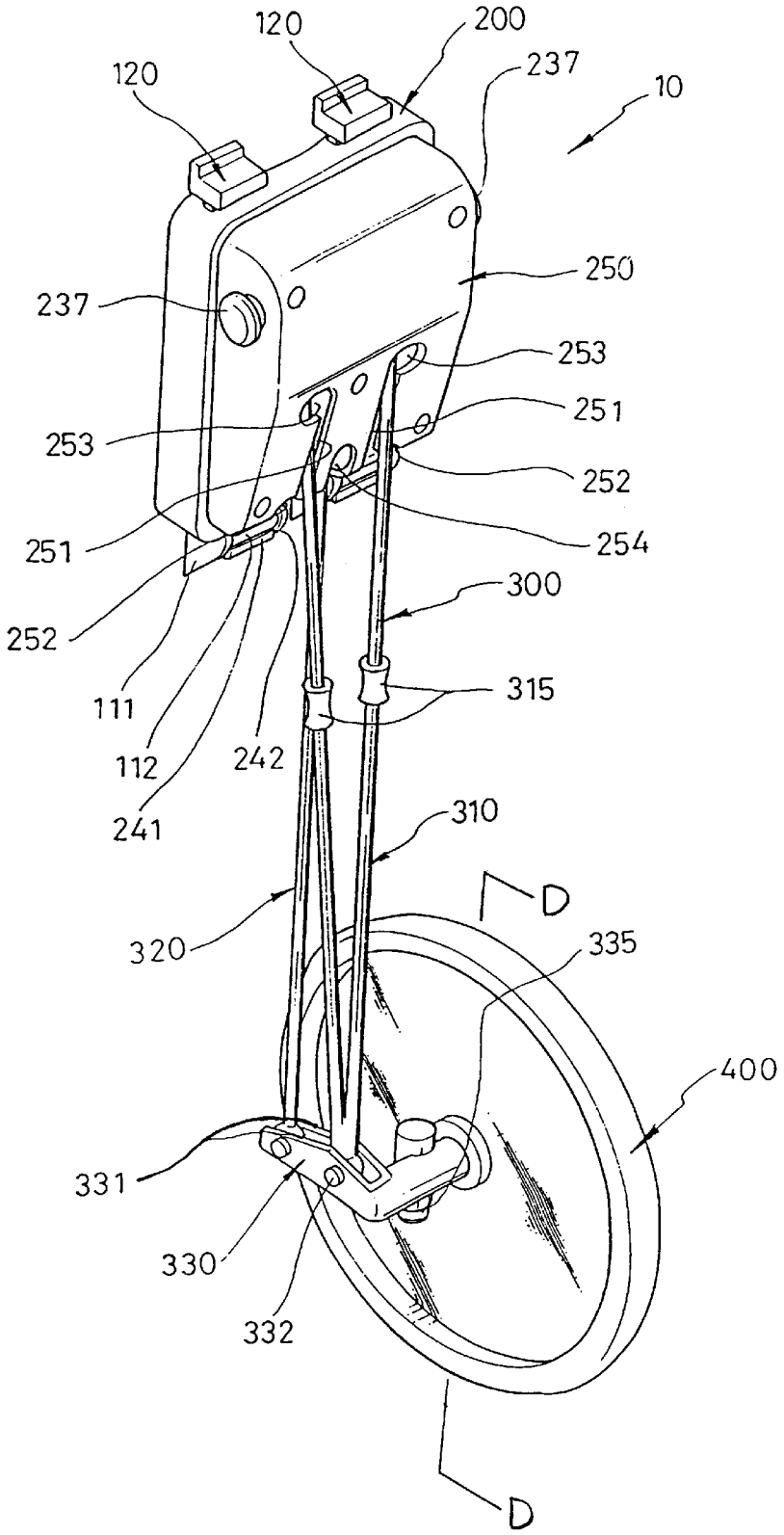
FIG. 3 is a detailed perspective view showing the carrier in accordance with the embodiment of the present invention.

Referring to FIGS. 1 to 3, a carrier 10 is detachably mounted to the body 2 of a golf bag 1. The carrier 10 comprises a pair of inner plates 100, a pair of outer plates 200, a pair of leg units 300, a pair of wheel units 400, and a handle unit 500.

Figure 4:
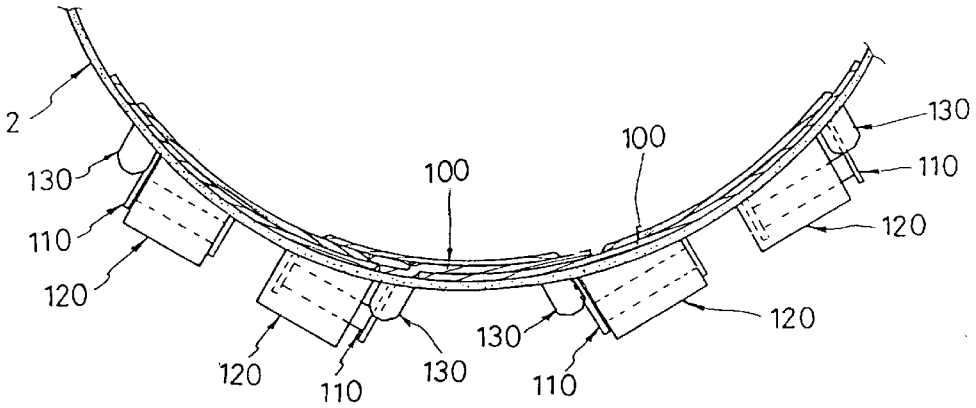
FIG. 4 is a cross-sectional view showing a part of the golf bag body in accordance with the embodiment of the present invention.
Figure 5:
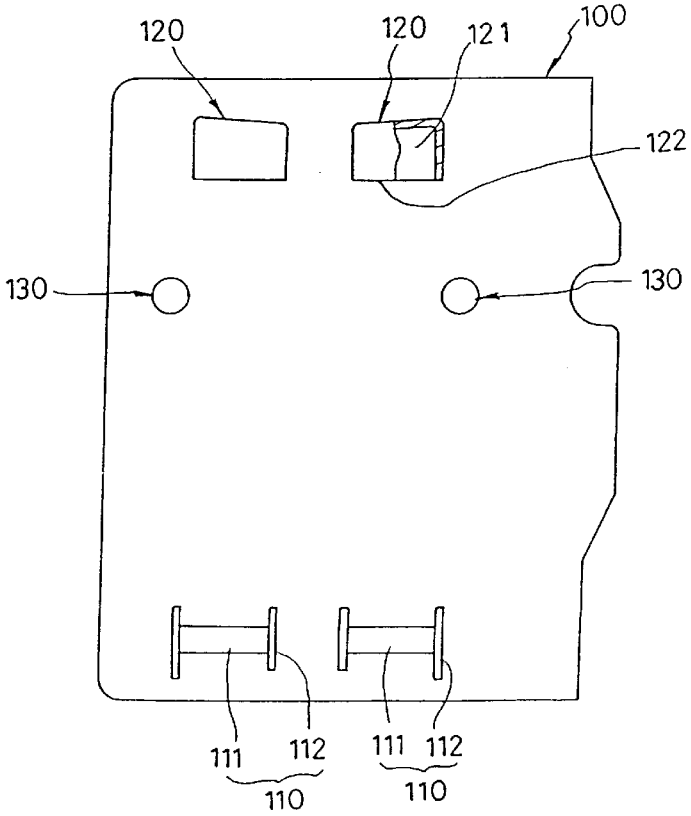
FIG. 5 is a front view showing an inner plate of the carrier in accordance with the embodiment of the present invention.
Figure 6:
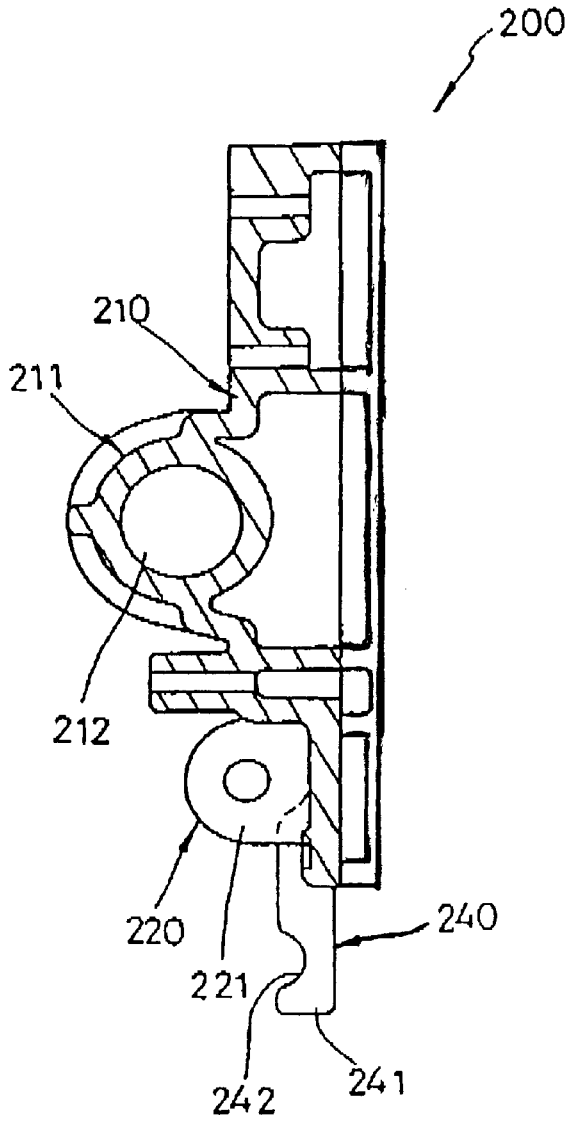
FIG. 6 is a cross-sectional view of the line A—A in FIG. 7 showing an outer plate of the carrier in accordance with the embodiment of the present invention.
Figure 7:
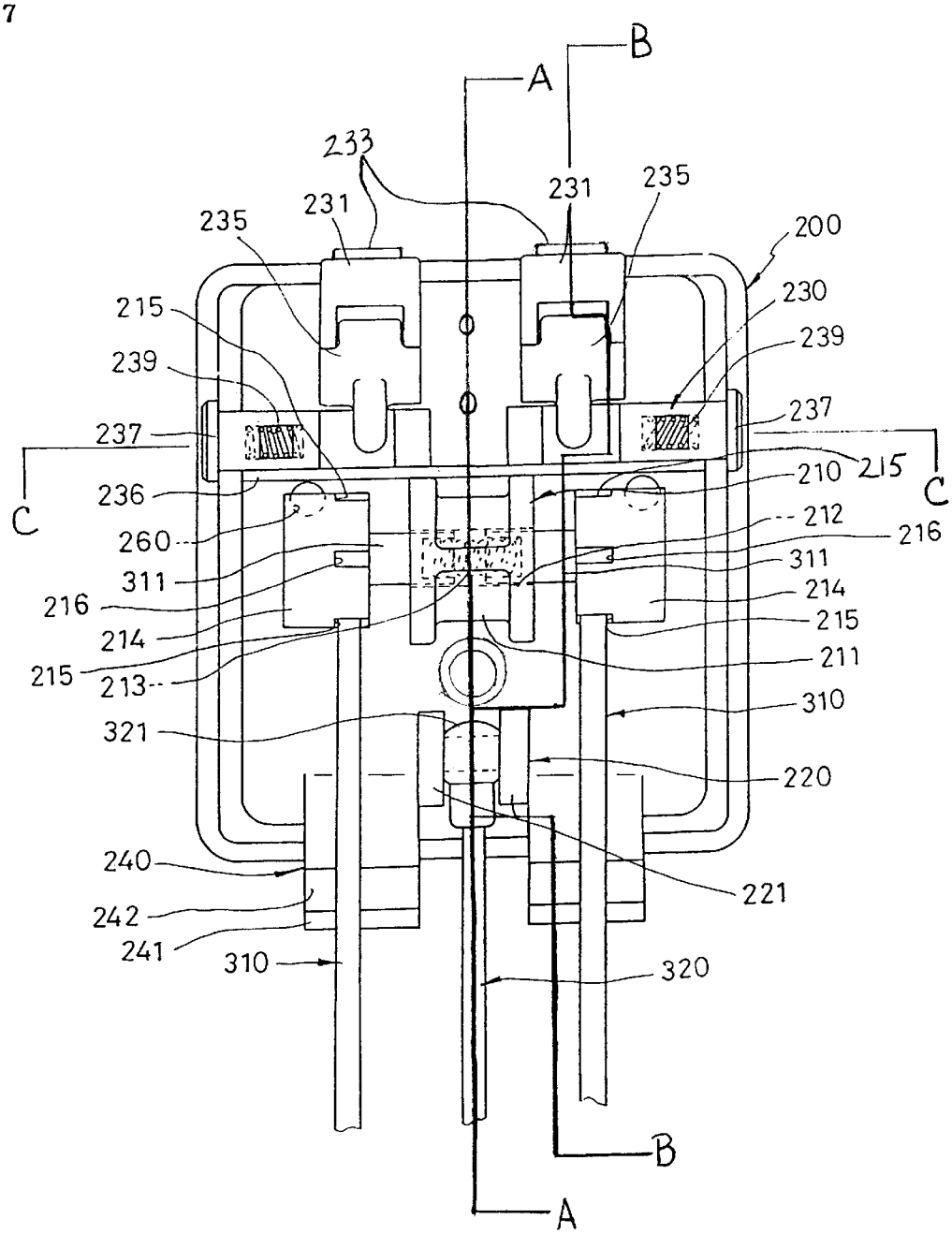
FIG. 7 is a front view showing a state in installing the operating means to the outer plate of the golf bag carrier from which a cover has been removed in accordance with the embodiment of the present invention.
Figure 8:
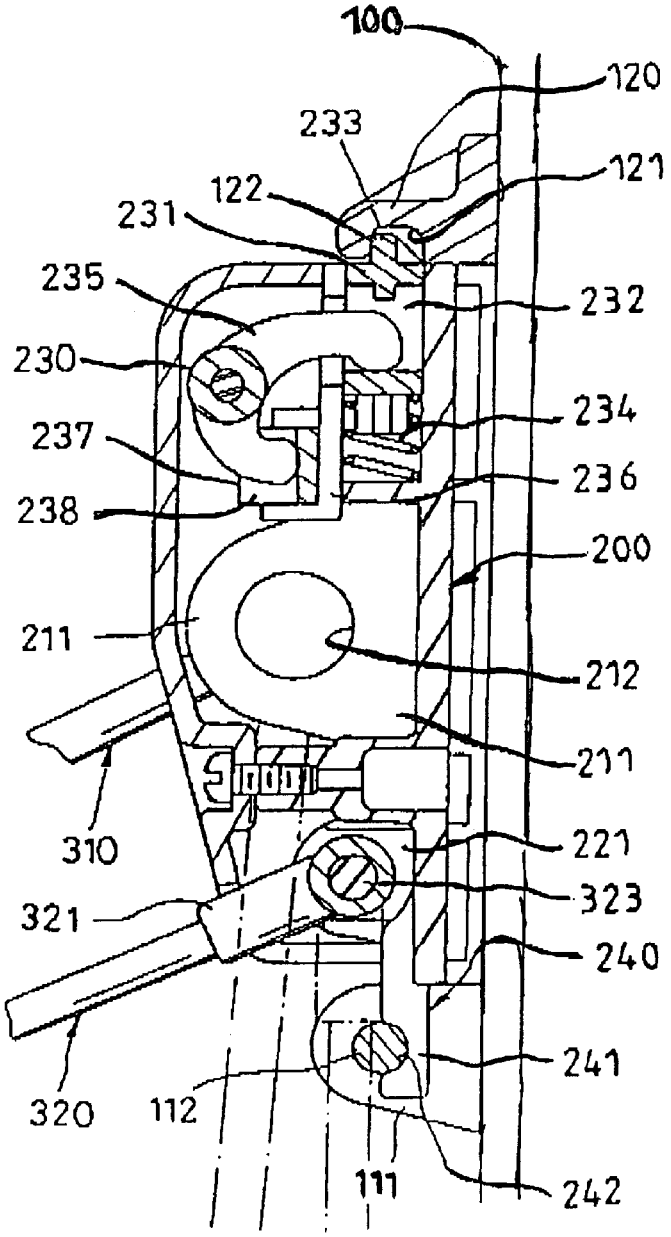
FIG. 8 is a cross sectional view of the line B—B in FIG. 7 showing a state in installing the operating means to the outer plate of the carrier in accordance with the embodiment of the present invention.
Figure 9:
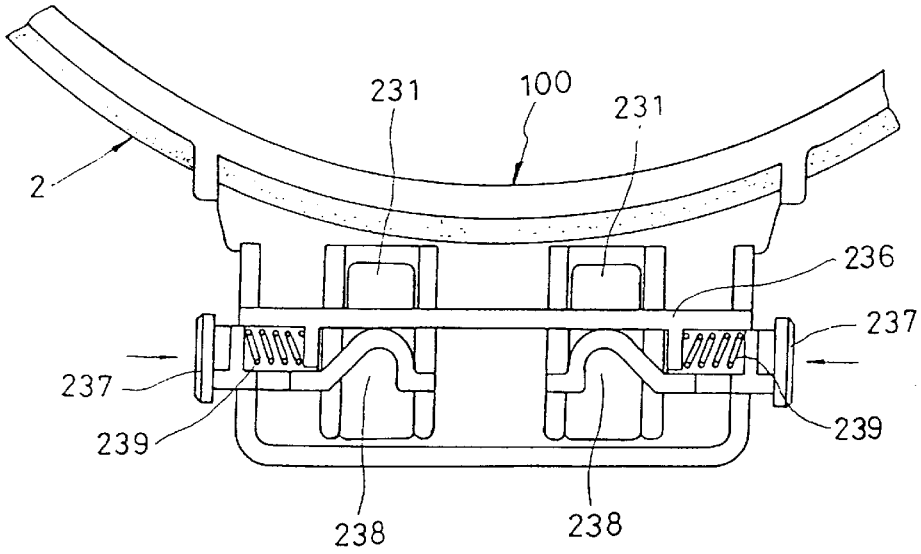
FIG. 9 is a transverse sectional view of the line C—C in FIG. 7 showing a state in installing the operating means to the outer plate of the carrier in accordance with the embodiment of the present invention.
Figure 10:
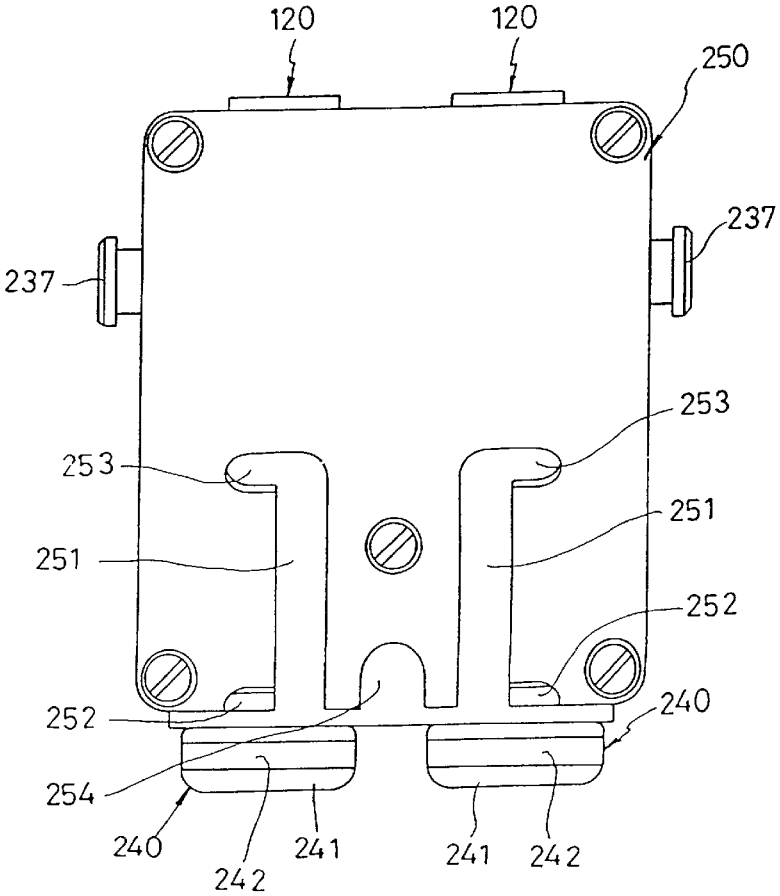
FIG. 10 is a front view showing a cover engaged with the outer plate of the carrier in accordance with the embodiment of the present invention.
Figure 11:
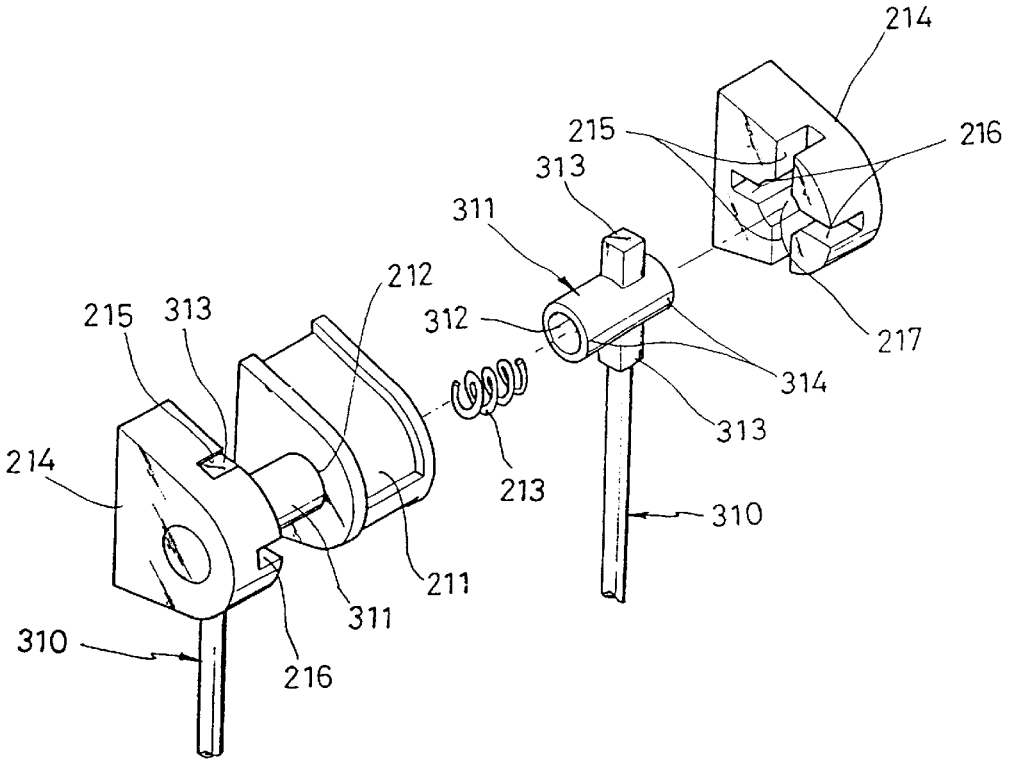
FIG. 11 is a partial exploded perspective view showing an engaged part of first leg of the carrier in accordance with the embodiment of the present invention.
Figure 12:
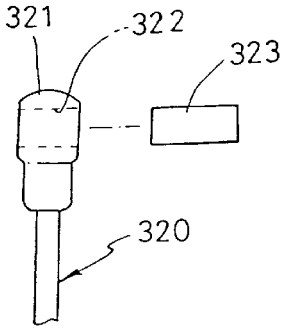
FIG. 12 is a partial exploded state view showing an engaging part of second leg of the carrier in accordance with the embodiment of the present invention.
Figure 13:
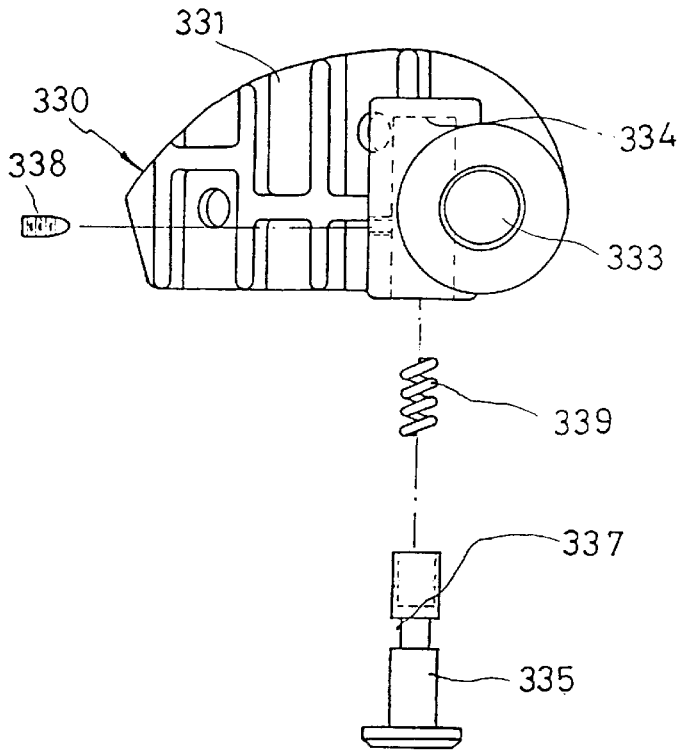
FIG. 13 is a partial exploded state view showing a trailing assembly of the carrier in accordance with the embodiment of the present invention.
Figure 14:
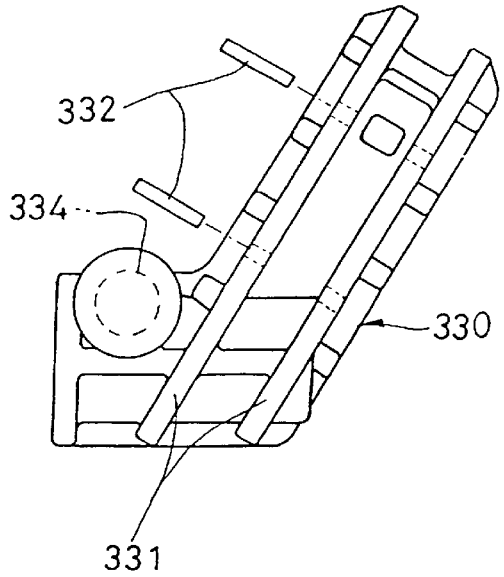
FIG. 14 is a partial exploded plan view showing a trailing assembly of the carrier in accordance with the embodiment of the present invention.

Referring to FIGS. 4 and 5, the inner plate 100 is a curved plate shaped member for detachably mounting the outer plate 200 to the body 2 of the golf bag 1. The inner plate 100 is closely attached to the inner peripheral edge of the body 2 of the golf bag 1. A supporting unit 110, a fastening member 120 and a guide rod 130 pass through the body 2 of the golf bag 1 and protrude from the front face of the inner plate 100. Since they also protrude from the outer peripheral edge of the inner plate 100, the inner plate 100 is smoothly engaged with the body 2.

The supporting unit 110 comprises a pair of brackets 111 formed opposing each other at a left lower side and a right lower side on the front of the inner plate 100, and hooking bars 112 engaged with the brackets 111 protruding from the outer peripheral edge of the body.

The fastening member 120, which has a rectangular shape, is protruded from upper side of the front of the inner plate 100. Fastening member 120 includes an inserting space 121 formed from the upper side to the lower side of the inner plate 100, and a hooking jaw 122 formed on the front face of the inserting space 121.

Hereafter, the guide rod 130 for smoothly fastening the outer plate 200 is described.

Referring to FIGS. 6 to 10, the outer plate 200 comprises first bearing units 210 rotatably supporting the upper ends of first legs 310, and a second bearing unit 220 rotatably supporting the upper end of a second leg 320. Fastening units 230 are mounted to the fastening members 120 of the inner plate 100. First supporting units 240 are in the hooking bars 112 of the supporting units 110 for fixing the lower part thereof. A cover 250 is engaged with the front face of the outer plate 200 for protecting the parts mounted to the outer plate 200 and guiding the first leg 310, and guide holes 260 for inserting the guide bars 130.

The first bearing unit 210 comprises a protruding block 211 formed at the center of the outer plates 200. The protruding block 211 includes a hole 212 formed to pass through its center. A spring 213 is inserted into the hole 212. Supporting blocks 214 are formed at the left side and right side of the protruding block 211 at the predetermined distance. First hooking grooves 215 are vertically formed on the one side surface of the protruding block 211 of the supporting block 214. Second hooking grooves 216 are formed at the predetermined angle with respect to the first hooking grooves 215 to intersect the first hooking grooves 215. A shaft groove 217 is formed in opposition to the hole 212 of the protruding block 211 at the intersection part.

The second bearing unit 220 comprises a pair of brackets 221 formed in opposition to each other at the center of the lower part of the outer plate 200.

The fastening unit 230 consists of a pair of operating members 235 for for moving a pair of fastening instruments 231 in upward and downward directions, for detaching/attaching the outer plate 200. A pair of operating buttons 237 controls the operation of the operating members 235. An auxiliary plate 236 guides the fastening instruments 231, the operating members 235, and the operating buttons 237. Herein, the fastening instrument 231 comprises a hooking piece 233 formed at the upper end part thereof. The hooking piece 233 is formed in vertical opposition to the inserting space 121. Also the fastening instrument 231 further comprises an insertion space 232 formed at the center part thereof, and a spring 234 mounted at the lower end part thereof. The one end of the operating members 235 is hooked in the insertion space 232. The spring 234 urges the fastening instrument 231 to move upward. Also, the operating member 235 is suitably formed in a seesaw type to rotatably support the center part thereof with a pin. The operating member 235 pushes the fastening instruments 231 downward when the operating member 235 is rotated in constant. On the other hand, the operating button 237 is horizontally mounted so that it is opposed to the lower end part of the operating member 235. Also, the operating button 237 comprises a hooking groove 238 into which the lower end part of the operating member 235 is inserted. The outer surface of the hooking groove 238 is tapered so that the operating member 235 is guided along the tapered surface thereof. Accordingly, the operating member 235 is rotated in constant when the operating button 237 goes straight ahead. A spring 239 is mounted to the inner end of the operating button 237 so that the button 237 is protruded from the inside to the outside. Also the auxiliary plate 236 comprises guide pieces and holes formed at predetermined positions so that the straight ahead movement of the operating button 237, the swing movement of the operating member 235 and the up and down movement of the fastening instrument 231 are maintained in stable.

The first supporting unit 240 comprises a pair of hooking pieces 241 formed to be exposed from the lower part of the outer plate 200, and a hooking groove 242 that is formed on the hooking piece 241. The first supporting unit 240 opposes the hooking bar 112 formed on the supporting unit 110 of the inner plate 100.

The cover 250 covering the front face of the outer plate 200 comprises elongated guide slots 251 formed at both sides. First guide grooves 252 are formed at the lower end part of each guide slot 251, and second guide grooves 253 are formed at the upper end part of the guide slot 251 to guide the first leg 310 to the left side or right side thereof. Also the cover 250 comprises a guide groove 254 formed at the center part of the lower end part thereof to guide the second leg 320.

The guide hole 260 into which the guide rod 130 is inserted functions to accurately engage with the carrier 100 and to securely maintain the engaged state even though a shock or a vibration is applied to it from the outside.

Referring to FIGS. 3, 7 and 8, and FIGS. 11 to 14, the leg unit 300 comprises a V-shaped first leg 310 for engaging the upper end part thereof with the supporting block 214 of the first bearing unit 210. A second leg 320 rotatably engages with a bracket 221 of the second bearing unit 220. A trailing assembly 330 rotatably engages with the lower end parts of the first and second legs 310 and 320.

The finishing member 311 attached to the upper end part of the first leg 310 is engaged with the supporting block 214 of the first bearing unit 210. Also the finishing member 311 comprises a supporting lug 313 which is inserted into the first and second grooves 215 and 216 and is formed in a longitudinal direction of the first leg 310. A shaft pin 314 forms at the intersect of the first leg 310. The shaft pin 314 is inserted into the shaft groove 217. The protruding block 211 comprises an insertion hole 212 into which a spring 213 is inserted. According to the above-described construction, the supporting lug 313 engaged with the upper end part of the first leg 310 is rotated with the shaft pin 314 while the shaft pin 314 maintains insertion in the shaft groove 217. A fitting piece 315 is mounted to the predetermined position of the first leg 310 so that the user may easily hold the first leg 310.

The second leg 320 comprises a finishing member 321 mounted to the upper end part thereof. A pin 323 passes through a hole 322 in the finishing member 321. The second leg 320 is rotatably engaged with the bracket 221 of the second bearing unit 220 by a pin 323.

The trailing assembly 330 comprises coupling pieces 331 formed in opposition of each other at the upper side thereof. The lower end parts of the first and second legs 310 and 320 are inserted between the coupling pieces 331. They are rotatably coupled with pins 332. Also the trailing assembly 330 comprises a shaft hole 333 formed at one end thereof for horizontally coupling with a rotational shaft 431 of the wheel unit 400, and an operating hole 334 upwardly formed at the position of the lower part thereof. The shaft hole 333 and the operating hole 334 are formed to intersect each other in a predetermined thick from the outer peripheral edges thereof. The intersection part is interconnected with each other. The spring 339 and the button 335 are inserted into the operating hole 334 in sequence. The button 335 is urged by the spring 339. An operating groove 337 is formed at the predetermined position of the outer peripheral edge of the button 335. Accordingly, when the user pushes the button, the operating groove 337 is positioned at the intersection part of the shaft hole 333 and the operating hole 334. The pin 338 acts as a stopper when inserted into the shaft hole 333 at the position of the operating groove 337 to prevent the button 335 from braking away, and to restrict the operating range of the button 335 within the range of the length of the operating groove 337. Hereinafter, the detailed description with respect to the trailing assembly 330 is described.

Figure 15:
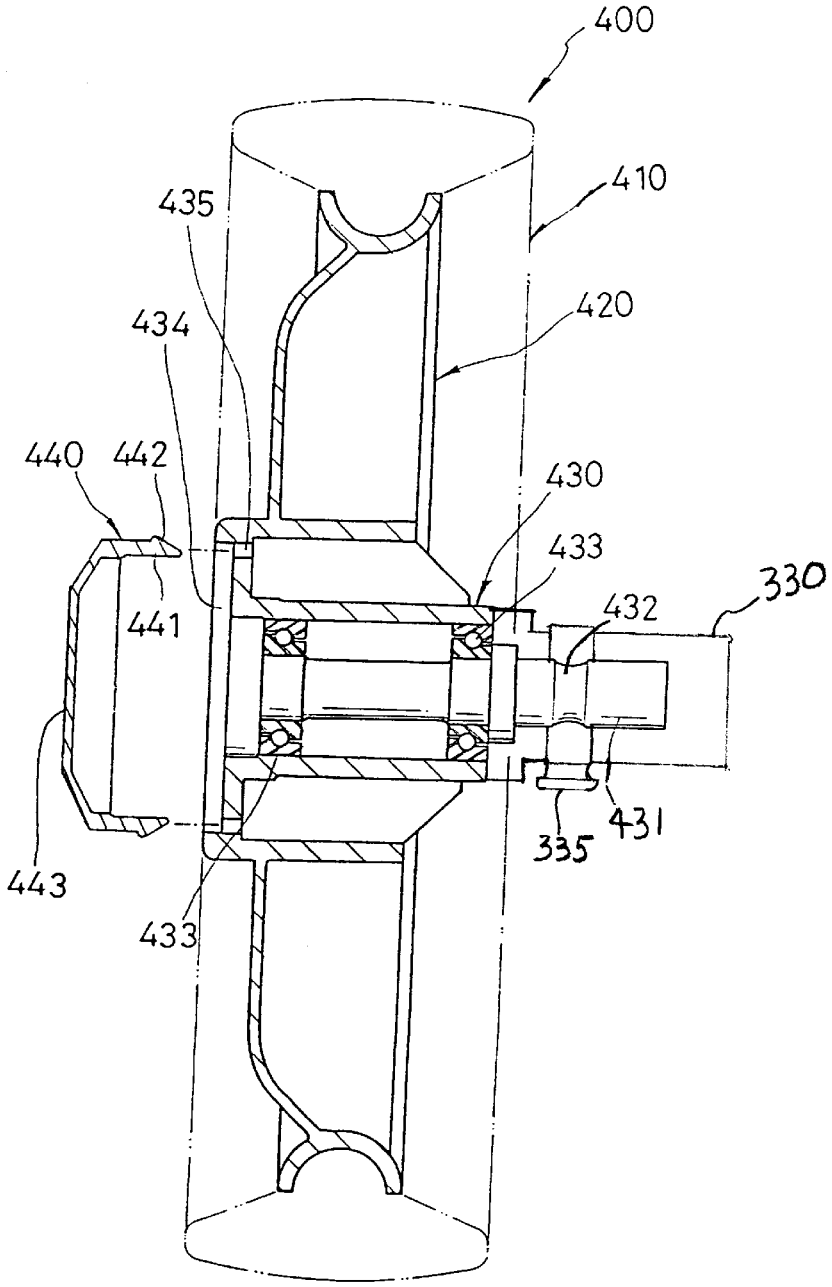
FIG. 15 is an exploded sectional view of the line D—D in FIG. 3 showing a wheel unit of the carrier in accordance with the embodiment of the present invention.

Referring to FIG. 15, the wheel unit 400 comprises a wheel 420, a tire 410 coupled with the outer peripheral edge of the wheel 420, a hub 430 formed at the center part of the wheel 420 and coupled with the rotational shaft 431 for smoothly rotating the tire 410, and a cover 440 for covering the outer surface of the wheel 420.

The hub 430 coupled with the rotational shaft 431 comprises a bearing 433 installed at a predetermined position therein so that the rotational shaft 431 is smoothly rotated. Also the hub 430 comprises a coupling part 434 formed at the outer surface thereof. The hooking hole 435 is formed at both ends of the coupling part 434.

The rotational shaft 431 comprises a hooking groove 432 formed at outer peripheral edge thereof. The hooking groove 432 is positioned at the intersection part of the operating hole 334 and the shaft hole 333 so that the rotational shaft 431 is completely inserted into the shaft hole 333 of the trailing assembly 330. Accordingly, when the rotational shaft 431 is completely inserted into the shaft hole 333 while the button 335 is pushed, the operating groove 337 of the button 335 is positioned in the intersection part of the shaft hole 333 and the operating hole 334. As a result, the insertion of the rotational shaft 431 is completely achieved. Also, when the button 335 is released, it protrudes to the outside due to the spring force of the spring 339. At the same time, since the outer peripheral of the body of the button 335 is fitted to the hooking groove 432 of the rotational shaft 431, the rotational shaft 431 may be maintained in the coupled state. In the case of disassembly, it is easily achieved by implementing the work of the reverse order of the above description while the button 335 is pushed.

The cover 440 comprises a display surface 443 formed at the outer surface thereof for displaying the characters and figures for a trademark and an advertisement. Inserting pieces 441 are formed in opposition to the hooking hole 435 of the hub 430 at the inner surface thereof. The hooking lugs 442 are formed on both ends of the inserting piece 441 are securely coupled with the hooking holes 435 formed at the coupling part 434 of the hub 430, thus it is capable of preventing contaminations such as dust from entering into the inside of the hub 430.

Figure 16:
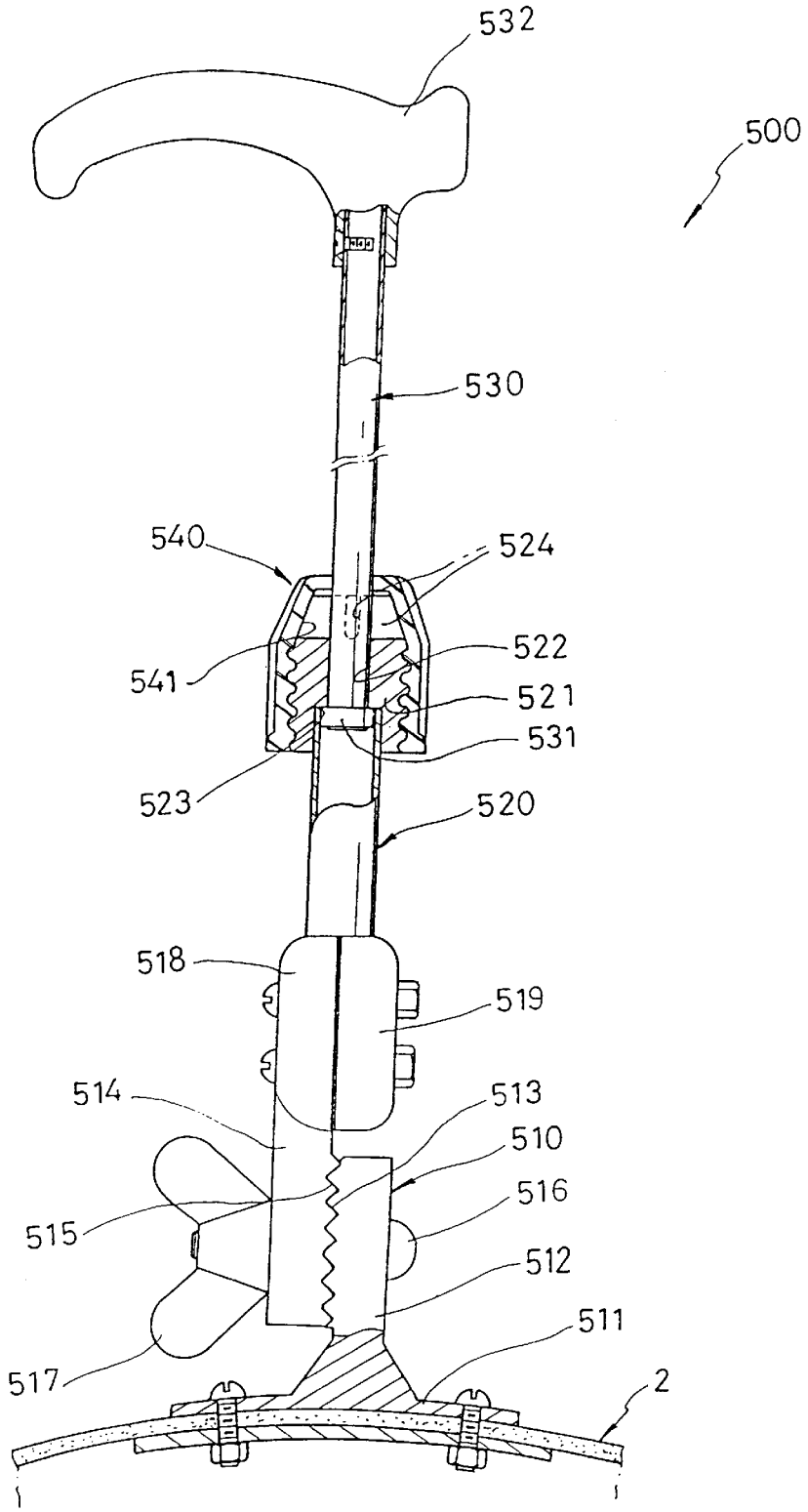
FIG. 16 is a partial sectional view showing a rotated state of the handle unit of the carrier in accordance with the embodiment of the present invention.

Referring to FIG. 16, a handle unit 500 comprises an angle adjusting assembly 510 for adjusting an angle in accordance to the user's requirements, a guide pipe 520 mounted to one end of the angle adjusting assembly 510, a length adjusting bar 530 mounted to one end of the guide pipe 520 for adjusting the entire length of the handle unit 500, and a length adjusting instrument 540 for fixing the length adjusting bar 530 to the guide pipe 520. The handle unit 500 is preferably mounted to the upper side of the outer peripheral edge of the body 2 of the golf bag 1. Also, the handle unit 500 is preferably mounted to the upper side of center part of the carrier 10 that is installed at both sides of the outer peripheral edge of the body 2 in symmetry.

The angle adjusting assembly 510 is fixed to the inner peripheral edge and the outer peripheral edge of the body 2 of the golf bag 1 by the bracket 511. The bracket 511 is fastened to the body 2 by using rivets or bolts and nuts. The angle adjusting assembly 510 comprises a first angle adjusting member 512 having saw teeth 513 formed on one side thereof, and a second angle adjusting member 514 having saw teeth 515 gear-engaged with the saw teeth 513 of the first angle adjusting member 512. Also, the first and second angle-adjusting members 512 and 514 comprise a shaft hole formed to pass through the saw teeth 513 and 515. A butterfly nut 517 is engaged with the shaft pin 516 that is inserted into the shaft hole and fastens these members 512 and 514. Accordingly, by releasing or tightening the butterfly nut 517 in a certain amount, it is capable of achieving an angle adjustment of the handle unit 500. That is, the user is capable of adjusting the angle of the handle unit 500 by adjusting the engage state of the first and second angle-adjusting members 512 and 514 using the butterfly nut 517. Also the second angle-adjusting member 514 comprises a fastening block 518. The fixed block 519 is engaged with the fastening block 518.

The one end of the guide pipe 520 is inserted between the fastening block 518 and the fixed block 519, and then they are fastened with rivets or bolts and nuts. Nipple 521 engaged with the other end of the guide pipe 520 has a tapered surface formed on the upper side of the outer peripheral edge thereof. Pluralities of the grooves 524 are formed on the tapered surface of the nipple 521 along the longitudinal direction. Also the nipple 521 has an insertion hole 522 passing through the center part thereof so that a hooking jaw 523 is formed. Herein, the inside diameter of the insertion hole 522 is less than that of the guide pipe 520.

The length adjusting bar 530 passing through the insertion hole 522 of the nipple 521 comprises a hooking member 531 formed at one end thereof opposing the hooking jaw 523 of the nipple 521, and a handle 532 formed at the other end thereof for the user. The hooking member 531 prevents the length adjusting bar 530 from being separated.

The length-adjusting instrument 540 engaged with the outer peripheral edge of the nipple 521 has a tapered part formed at the screw part of the inner peripheral edge of the nipple 521. Accordingly, when the length-adjusting instrument 540 is rotated clockwise, the tapered part of the nipple 521 is guided to the tapered part of the length-adjusting instrument 540, so that the groove 524 of the nipple 521 is to be narrowed. As a result, the length-adjusting instrument 540 is securely fixed to the length adjusting bar 530. When the length-adjusting instrument 540 is rotated in an opposite direction, the engagement of the length adjusting bar 530 is released in reverse order.

Figure 17:
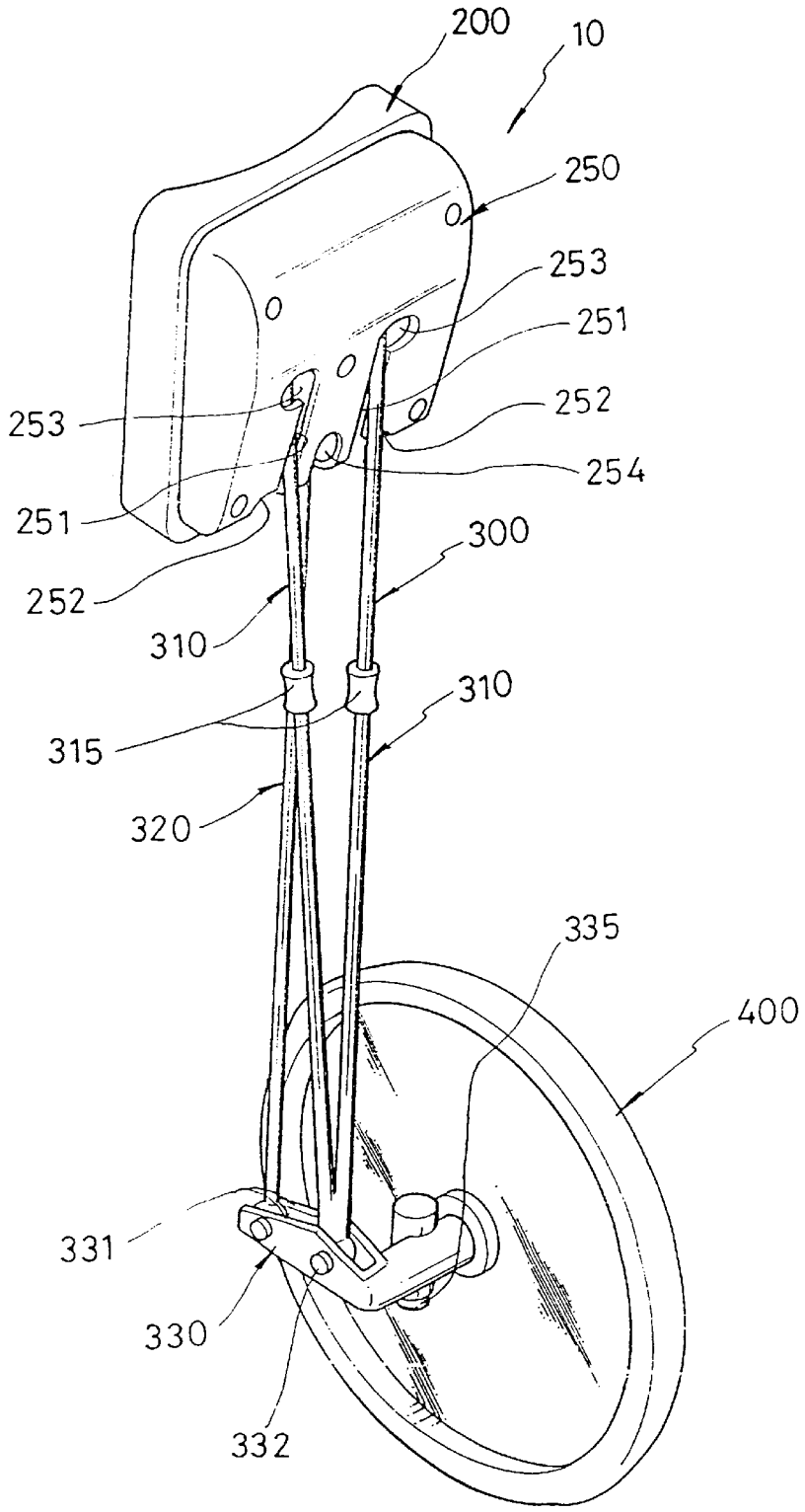
FIG. 17 is a detailed perspective view showing the carrier in accordance with another embodiment of the present invention.
Figure 18:
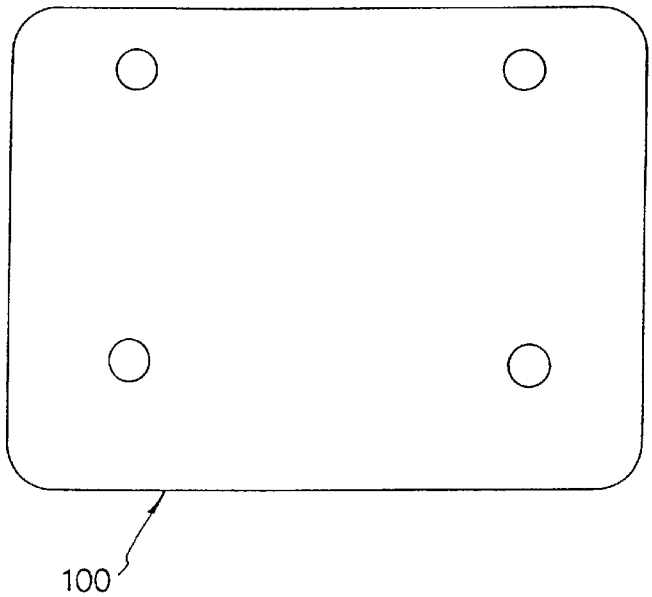
FIG. 18 is a front view showing an inner plate of the carrier in accordance with the another embodiment of the present invention.
Figure 19:
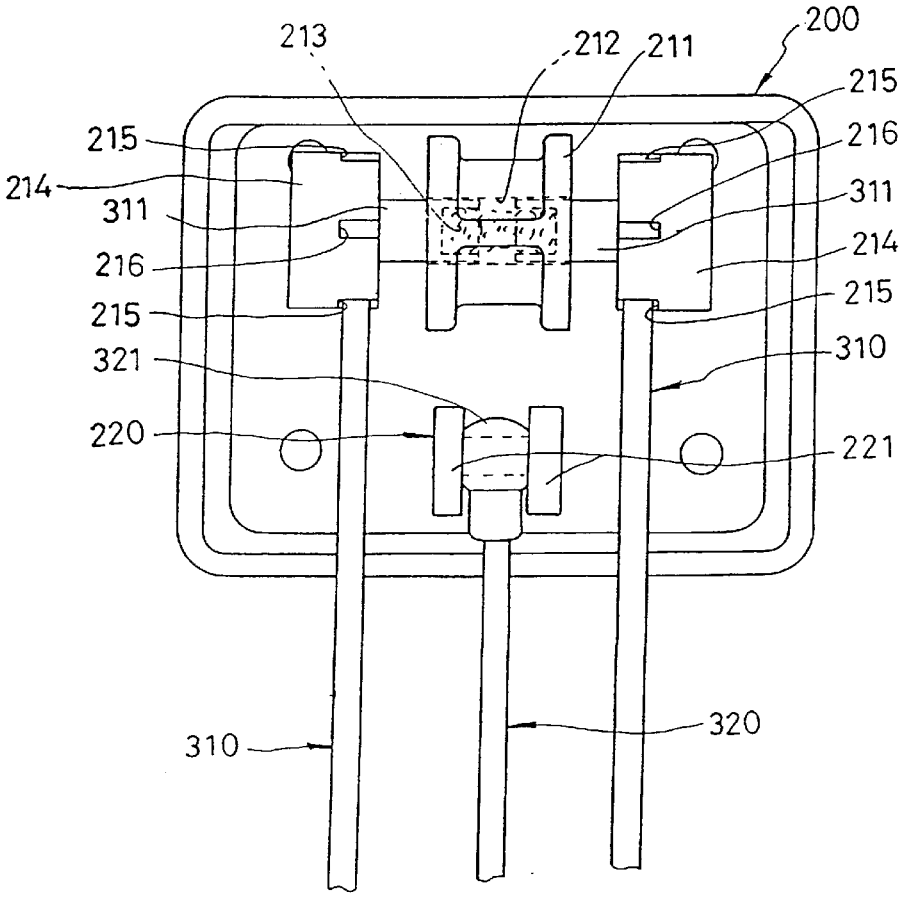
FIG. 19 is a front view showing a state in installing the operating means to the outer plate of the carrier in accordance with the another embodiment of the present invention after removing a cover.

Referring to FIGS. 17 to 19, another carrier according to the present invention comprises: an inner plate 100 having fastening holes formed in a body 2 of a golf bag 1; an outer plate 200 having fastening holes formed in opposing to the fastening holes of the inner plate 100 for closely attaching it to the outer peripheral edge of the body 2, a first bearing unit 210, a second bearing unit 220 and a cover 250, and also fastening the inner plate 100 to the outer peripheral edge of the body 2; a leg unit 300; a wheel unit 400; and a handle unit 500. According to the above-described construction, it is capable of achieving compaction and stability of the golf bag carrier.

That is, in this embodiment, since the fastening unit 230 is removed, and the inner and outer plates 100 and 200 are fastened with an ordinary fastener, that is, the carrier is a one body. Accordingly, the sizes of the inner and outer plates 100 and 200 are minimized, which is capable of reducing the manufacturing cost of the apparatus.

Hereinafter, the work of the present invention is described.

Firstly, in order to use the carrier 10 mounted to the body 2 of the golf bag 1 in the state that the carrier 10 is folded, the fitting piece 315 mounted to the V-shaped first leg 310 is pushed inward. And then the finishing members 311 mounted to the upper end of the first legs 310 are released from the first hooking grooves 215 formed on the supporting blocks 214 of the first bearing units 210, and moved to the protruding blocks 211. Accordingly, when the finishing members 311 compress the spring 213 of the protruding block 211 inserted into the insertion hole 312 of the finishing members 311, and the insertion hole 312 thereof is deeply moved into the hole 212 and then is positioned between the protruding block 211 and the supporting block 214. At this time, the first legs 310 are released from the first guide grooves 252 of the cover 250, and then are positioned at lower ends of the elongated guide slots 251, Accordingly, the first legs 310 are pushed upward. When the first legs 310 are pulled above the elongated guide slots 251, they are moved to the upper ends of the elongated guide slots 251. At this time, the fitting pieces 315 are released from the fitting state. When the fitting pieces 315 are released from the fitting state, the finishing members 311 of the first legs 310 are away from the protruding block 211 due to the spring force of the spring 213 of the protruding block 211. As a result, the first legs 310 are again widened. Also since the supporting lugs 313 and the shaft pin 314 of the finishing members 311 are guided to the second guide grooves 253 outwardly formed at the upper ends of the elongated guide slots 251, and then are inserted and hooked into the second hooking grooves 216 and the shaft grooves 217 of the supporting block 214, the first legs 310 are maintained in a widened state. On the other hand, since the second leg 320 is coupled to the second bearing unit 220 by the pin 323, it is always freely rotatable and is rotated in interlocked with the rotation of the first legs 310. Also the lower ends of the first legs 310 and the second leg 320 are inserted between the coupling pieces 331 of the trailing assembly 330, and are coupled with the pin 332. Therefore, they are freely rotated in interlocked with the rotation of the first legs 310 and the second leg 320. As above-described, when the first legs 310 and the second leg 320 of the carrier 10 installed to the body 2 of the golf bag 1 are widened, it is capable of using the golf bag 1 in an inclined state with respect to the bottom position of the body 2 and the right and left positions of the wheel unit 400 attached to the lower part of the leg unit 300. That is, since the body 2 of the golf bag 1 is substantially formed in cylindrical shape and the carrier 10 is installed at both sides of the outer peripheral edge of the body 2 in symmetry at a predetermined distance, the carrier 10 is closed to the outer peripheral edge of the body 2 in the case of folding the legs 310 and 320. The carrier 10 is widened more than the diameter of the body 2 in the case of unfolding the legs 310 and 320. Accordingly, it is capable of stably standing the golf bag 1 on the ground.

In this situation, the user is capable of adjusting the length and the angle of the handle unit 500.

Firstly, in order to adjust the angle of the handle unit 500, the butterfly nut 517 of the angle adjusting assembly 510 is released in a certain amount to be released from the engagement state of the first angle-adjusting member 512 and the second angle-adjusting member 514. Thereafter, the angle of the adjusting assembly 510 is readjusted by rotating the second angle-adjusting member 514 at a desired angle. And then the saw teeth 513 of the first angle-adjusting member 512 and the saw teeth 515 of the second angle-adjusting member 514 are securely engaged by tightening the nut 517. As a result, the angle between the guide pipe 520 coupled to the second angle adjusting member 514 and the length adjusting bar 530 coupled to the guide pipe 520 is adjusted and established to the value desired by the user.

On the other hand, in order to adjust the length of the handle unit 500, the length-adjusting unit 540 is released in a certain amount to be released from the tightened state of the length adjusting bar 530 by a groove 524 of the nipple 521. The length adjusting bar 530 is movable to be passed through the insertion hole 522 of the nipple 521. Accordingly, it is capable of adjusting the length of the length adjusting bar 530 and then maintaining it in adjusted state. Since the upper side of the screw part of the length-adjusting instrument 540 has a tapered part, the groove 524 formed on the tapered part is narrowed according to the rotation of the screw part so that the length adjusting bar 530 is securely fixed to the desired position.

In order to use the carrier installed to both sides of the body 2 of the golf bag 1, the user holds the handle 532 engaged with the length adjusting bar 530 of the handle unit 500 and obliquely lies the body 2 of the golf bag 1 on the ground in the state that the first and the second legs 310 and 320 are entirely widened and the adjustment for the angle and length of the handle unit 500 are completed. The bottom surface of the body 2 of the golf bag 1 comes down on the ground. At this time, it is capable of easily moving the golf bag 1 to the desired position while the length adjusting bar 530 is being pulled.

On the other hand, the wheel unit 400 comprises the hooking groove 432 formed in opposition to the intersection position of the shaft hole 333 and the operating hole 334 of the trailing assembly 330 in the outer peripheral edge of the rotational shaft 431 of the hub 430. Accordingly, when the button 335 is pushed, the button 335 compresses the spring 339 inserted into the operating hole 334 for moving the operating groove 337 of the button 335 to the intersection position of the shaft hole 333 and the operating hole 334. As a result, the body of the button 335 hooked in the hooking groove 432 of the rotational shaft 431 escapes from the groove 432, and the rotational shaft 431 also escapes from the hooking state. At this time, since the rotational shaft 431 is released, it is capable of easily separating the wheel unit 400 from the carrier 10.

In order to assemble the wheel unit 400, the rotational shaft 431 is inserted into the shaft hole 333 in the state that the button is pushed, and then the operating groove 337 of the button 335 is moved to the intersection position of the shaft hole 333 and the operating hole 334. At this time, when the hooking groove 432 of the rotational shaft 431 is positioned at the intersection position of the shaft hole 333 and the operating hole 334, the pushed state of the button 335 is released. Accordingly, since the button 335 is outwardly protruded by the spring force of the spring 339, the outer peripheral edge of the button 335 is inserted into the hooking groove 432 of the rotational shaft 431 positioned at the intersection position of the shaft hole 333 and the operating hole 334 to securely maintain the engaged state. As above described, since the wheel unit 400 is simply detached/attached from/to the trailing assembly 330, the packing or the transport of the golf bag 1 may be easily achieved. And also since the assembling work is implemented in a state that the weight and volume of the apparatus is minimized, it is capable of improving the workability and productivity.

In order to detach the carrier 10 from the body 2 of the golf bag 1, the operating buttons 237 protruded from the both sides of the outer plate 200 are pushed. At this time, the one end of the operating member 235 is guided to the inclined surface of the hooking groove 238 of the operating button 237, and then the operating member 235 is rotated so that the fastening instrument 231 is moved to the lower side to compress the spring 234. Accordingly, since the fastening instrument 231 which is inserted into the insertion space 121 of the fastening member 120 and is hooked in the front face of the hooking jaw 122 of the insertion space 121 is moved to the lower side, the upper end of the fastening instrument 231 escapes from the insertion space 121 of the fastening member 120 to be released. When the locking of the fastening instrument 231 is released, the outer plate 200 is forwardly pulled, so that the hooking state of the hooking groove 242 that is formed on the hooking piece 241 of the first supporting unit 240 is separated from the inner plate 100. Accordingly, the body 2 and outer plate 200 are completely separated.

In order to attach the carrier 10 to the body 2 of the golf bag 1, the hooking piece 241 of the first supporting unit 240 is inserted between the hooking bar 112 and the outer peripheral edge of the body 2, and then the hooking groove 242 of the hooking piece 241 is positioned to coincide with the hooking bar 112. Thereafter the upper side of the outer plate 200 is closed to the body 2 while the operating button 237 is pushed. At this time, the guide rod 130 inserted into the guide hole 260 functions to prevent it from swing and to accurately close to the guide hole 260. Also when the operating button 237 is pushed, the one end of the operating member 235 is guided to the inclined surface of the hooking groove 238, and then the operating member is rotated. Accordingly, the other end of the operating member 235 inserted into the insertion space 232 of the fastening instrument 231 is rotated, so that the fastening instrument 231 is moved to the lower part while pushing the spring 234. In this situation, when the outer plate 200 is completely closed to the body 2 of the golf bag 1 and the pushed state of the operating button 237 is released, the fastening instrument 120 is moved to the upper side by the spring force of the spring 234. Accordingly, since the upper hooking piece 233 of the fastening instrument 231 to be inserted into the insertion space 121 of the fastening member 120 is hooked in the hooking jaw 122, the locking state is lastly maintained.

On the other hand, when the outer plate 200 is separated from the body 2 of the golf bag 1, the separating work is implemented while pushing the operating button 237. However, when the outer plate 200 is engaged with the body 2, the hooking piece 241 is inserted between the hooking bar 112 of the supporting unit 110 and the outer peripheral edge of the body 2, and then the hooking groove 242 of the hooking piece 241 is coincided with the hooking bar 112. Accordingly, the engaging work is achieved by simply closing the outer plate 200 to the outer peripheral edge of the body 2 without pushing the button 335.

As described above, the present invention provides a golf bag equipped with a carrier capable of simply and conveniently carrying the golf bag by coupling the carrier to the body of the golf bag without a separate cart. In non-use, it is capable of keeping the golf bag and the carrier in separated state or packing them in a box. Also, the present invention provides a golf bag equipped with a carrier capable of easily adjusting the angle of the carrier while carrying the golf bag and standing it on the ground. Furthermore since the golf bag equipped with a carrier of the present invention has a simple construction and a small number of parts, and the wheel unit is able to be separated, it is capable of easily replacing the damaged parts when problems are generated.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

Reference Numeral in Drawings

1; golf bag
10; carrier
110; supporting unit
130; guide rod
210; first bearing unit
213; spring
215; first hooking groove
220; second bearing unit
230; fastening unit
234; spring
238; hooking groove
240; first supporting unit
251; elongated guide slot

253; second guide groove
300; leg unit
320; second leg
400; wheel unit
420; wheel
440; cover
510; angle adjusting assembly
530; length adjusting bar
540; length adjusting instrument
2; body
100; inner plate
120; fastening member
200; outer plate
211; protruding block
214; supporting block
216; second hooking groove
221; bracket
231; fastening instrument
237; operating button
239; spring
250; cover
252; first guide groove
260; guide hole
310; first leg
330; trailing assembly
410; tire
430; hub
500; handle unit
520; guide pipe

What is claimed is:

1. A golf bag equipped with a carrier comprising:

an inner plate attached to the inner peripheral edge of said golf bag;

an outer plate fastened to said inner plate at the position of the outer peripheral edge of said golf bag;

a leg unit rotatably coupled with the front face of said outer plate;

a first bearing unit coupled with the front face of said outer plate for controlling the angle of said leg unit;

a cover coupled with the front face of said outer plate;

a wheel unit coupled with the lower part of said leg unit for moving said golf bag; and a handle unit coupled with the upper side of the outer peripheral edge of said golf bag.

2. The golf bag as defined in claim 1, wherein said inner plate comprises supporting units, each of said supporting units including a pair of brackets attached to the lower side thereof opposing each other and hooking bars formed at both ends of each bracket, fastening members, each of said fastening members including an inserting space formed to open the bottom surface thereof and a hooking jaw formed at the front face of said inserting space, and guide bars for guiding an outer plate to be coupled with said inner plate at a predetermined position.

3. The golf bag as defined in claim 2, wherein said outer plate comprises a first bearing unit for rotatably supporting the upper end of a first leg at the center of the front face of said outer plate and for controlling the angle of said first leg, a second bearing unit for rotatably supporting the upper end of a second leg at the lower part of the center of the front face of said outer plate, fastening units, each of said fastening units including a detachable fastening instrument attached to said fastening member of said inner plate at both sides of the upper part of the front face of said outer plate, first supporting units, each of said first supporting units being hooked on the hooking bar of said supporting unit at both sides of the lower part of the front face of said outer plate, a cover coupled with the front face of said outer plate, said cover having guide grooves for guiding the first leg and the second leg, and guide holes for inserting said guide bars at predetermined positions of said outer plate.

4. The golf bag as defined in claim 3, wherein each of said first bearing units comprises a protruding block protruded from the center part of said outer plate, said protruding block having a hole into which a spring is inserted, a supporting block formed at a predetermined distance from said protruding block, a first hooking groove formed on said supporting block to be directed to said protruding block, a second hooking groove forming an intersection part with said first hooking groove at a predetermined angle, and a shaft groove formed at said intersection part, wherein said shaft groove and said hole of said protruding block are opposing each other.

5. The golf bag as defined in claim 3, wherein each of said fastening units comprises an operating member for moving a fastening instrument in upward and downward directions for attaching/detaching said outer plate, an operating member for moving said fastening instrument in upward and downward, and an operating button for controlling said operating member.

6. The golf bag as defined in claim 3, wherein said fastening instrument comprises a hooking piece formed at the upper end thereof in opposing to said inserting space which is formed on said fastening member of said inner plate, an insertion space into which one end of said operating member is inserted, said insertion space being formed at the center of said fastening instrument, and a spring formed at the lower end of said fastening instrument for upwardly urging said fastening instrument.

7. The golf bag as defined in claim 5, wherein said fastening instrument comprises a hooking piece formed at the upper end thereof in opposing to said inserting space which is formed on said fastening member of said inner plate, an insertion space into which one end of said operating member is inserted, said insertion space being formed at the center of said fastening instrument, and a spring formed at the lower end of said fastening instrument for upwardly urging said fastening instrument.

8. The golf bag as defined in claim 5, wherein said operating member of a seesaw type is installed in vertical, its central part is coupled with a pin, its upper end is inserted into said insertion space of said fastening instrument, and its lower end is hooked into a hooking groove of said operating button.

9. The golf bag as defined in claim 5, wherein said operating button is horizontally installed opposing the lower end of said operating member, and has a hooking groove into which the lower end of said operating member is inserted and a spring being inserted into said operating button, the outer surface of said hooking groove is tapered, said spring outwardly urges said operating button.

10. The golf bag as defined in claim 5, wherein each of said first supporting unit comprises a hooking piece formed at the lower part of said outer plate to be exposed, said hooking pieces include a hooking groove formed opposing said hooking bar formed on said supporting unit of said inner plate.

11. The golf bag as defined in claim 4, wherein said guide groove for guiding said first leg formed in a longitudinal direction at both sides of said outer plate and comprising a first guide groove portion outwardly formed at the lower end, a second guide groove portion outwardly formed at the upper end wherein a user controls the angle of said first leg between the first hooking groove and the second hooking groove of said supporting block, and said guide groove for guiding said second leg comprising a third guide groove at the center of the lower part of said cover.

12. The golf bag as defined in claim 1, wherein said leg unit comprises a V-shaped first leg rotatably coupled with both sides of a protruding block of said first bearing unit, a second leg rotatably coupled with a bracket of a second bearing unit, and a trailing assembly rotatably coupled with the lower ends of said first and second legs.

13. The golf bag as defined in claim 3, wherein said leg unit comprises a V-shaped first leg rotatably coupled with both sides of a protruding block of said first bearing unit, a second leg rotatably coupled with a bracket of a second bearing unit, and a trailing assembly rotatably coupled with the lower ends of said first and second leg.

14. The golf bag as defined in claim 4, wherein said leg unit comprises a V-shaped first leg rotatably coupled with both sides of said protruding block of said first bearing unit, a second leg rotatably coupled with a bracket of a second bearing unit, and a trailing assembly rotatably coupled with the lower ends of said first and second leg.

15. The golf bag as defined in claim 14, wherein said first leg comprises a finishing member attached to the upper end thereof, a supporting lug which is inserted into said first hooking groove or said second hooking groove of said supporting block, said supporting lug is formed in a longitudinal direction at the upper side of said first leg, and a shaft pin extended to both sides of said finishing member, one end of said shaft pin facing said supporting block is inserted into said shaft groove, and the other end of said shaft pin facing said protruding block has an insertion hole into which a spring is inserted.

16. The golf bag as defined in claim 12, wherein said trailing assembly comprises coupling pieces upwardly opposing each other at the upper part thereof, a shaft hole coupled with a rotational shaft of said wheel unit, an operating hole formed in vertical at one end of said shaft hole, the lower ends of said first leg and said second leg are coupled between said coupling pieces by pins, an intersection part of said shaft hole and said operating hole is interconnected, a spring being inserted into said operating hole, and a button which is urged by said spring, said button having an operating groove formed at the outer peripheral thereof, thereby positioning said operating groove at the intersection part of said shaft hole and said operating hole when said button is completely inserted into said operating hole.

17. The golf bag as defined in claim 1, wherein said wheel unit comprises a wheel, a tire coupled with an outer peripheral edge of said wheel, a hub formed at the center part of said wheel, a rotational shaft coupled with said hub for smoothly rotating said tire, and a cover for covering an outer surface of said wheel to prevent dust from entering therein.

18. The golf bag as defined in claim 16, wherein said wheel unit comprises a wheel, a tire coupled with an outer peripheral edge of said wheel, a hub formed at the center part of said wheel, a rotational shaft coupled with said hub for smoothly rotating said tire, and a cover for covering an outer surface of said wheel to prevent dust from entering therein wherein said hub comprises a hooking groove formed at an outer peripheral edge of said rotational shaft, said hooking groove is positioned at the intersection part of said shaft hole and said operating hole of said trailing assembly.

19. The golf bag as defined in claim 1, wherein said handle unit comprises an angle adjusting assembly for adjusting an angle according to a user's requirements, a guide pipe mounted to one end of said angle adjusting assembly, a length adjusting bar mounted to the other end of said angle adjusting assembly for adjusting the entire length of said handle unit, and a length adjusting instrument for fixing said length adjusting bar to said guide pipe.

20. The golf bag as defined in claim 19, wherein said angle adjusting assembly comprises a bracket for fixing the outer peripheral edge and inner peripheral edge of said golf bag to said angle adjusting assembly, a first angle adjusting member having saw teeth formed on one side thereof, and a second angle adjusting member having saw teeth gear-engaged with the saw teeth of the first angle adjusting member, said first and second angle adjusting members comprise a shaft hole formed to pass through the saw teeth, said members are fastened by a butterfly nut that is engaged with a shaft pin and inserted into the shaft hole.

21. The golf bag as defined in claim 19, wherein one end of said guide pipe is fixed to said angle adjusting assembly, the other end of said guide pipe is fixed to a nipple, said nipple has a tapered surface formed on the upper side of the outer peripheral edge thereof, an insertion hole passing through the center part thereof, and a hooking jaw formed by making the diameter of said insertion hole smaller than that of said guide pipe.

22. The golf bag as defined in claim 21, wherein said length adjusting bar is formed to pass through said insertion hole, one end of said length adjusting bar is inserted into said guide pipe, said length adjusting bar comprises a hooking member formed at one end thereof and opposed to said hooking jaw of said nipple, and a handle formed at the other end thereof for the user.

23. The golf bag as defined in claim 21, wherein said length adjusting instrument is coupled with the outer peripheral edge of said nipple of said guide pipe, and said length adjusting instrument has a screw part formed at the inner peripheral edge thereof, and a tapered part formed at the upper side of the screw part in opposition to the tapered part of said nipple.

* * * * *